US005636778A

United States Patent [19]

Jones et al.

[11] Patent Number: 5,636,778

[45] Date of Patent: Jun. 10, 1997

[54] DOUBLE STRAP SYSTEM FOR GOLF BAGS

[75] Inventors: George H. Jones, Lake Oswego, Oreg.; Gregory M. Suggs, Phoenix, Ariz.

[73] Assignee: Karsten Manufacturing Corporation, Phoenix, Ariz.

[21] Appl. No.: 531,407

[22] Filed: Sep. 21, 1995

[51] Int. Cl.[6] ..... A45F 3/04

[52] U.S. Cl. ..... 224/627; 224/258

[58] Field of Search ..... 224/578, 580, 224/627, 259, 258, 209

[56] References Cited

U.S. PATENT DOCUMENTS

| | | | |
|---|---|---|---|
| 2,820,498 | 1/1958 | Endee . | |
| 2,853,111 | 9/1958 | Williams . | |
| 5,042,704 | 8/1991 | Izzo | 224/209 |
| 5,269,449 | 12/1993 | Sattler | 224/258 |
| 5,348,205 | 9/1994 | Steurer | 224/627 |
| 5,499,761 | 3/1996 | Reimers | 224/257 |

FOREIGN PATENT DOCUMENTS

| | | | |
|---|---|---|---|
| 2677235 | 12/1992 | France | 224/209 |

*Primary Examiner*—Renee S. Luebke

*Attorney, Agent, or Firm*—Darrell F. Marquette

[57] ABSTRACT

A double strap system for golf bags includes a first shoulder strap having upper and lower ends attached to a generally tubular body of a golf bag at first and second locations, respectively. In one embodiment of the double strap system, the lower end of the first shoulder strap is connected to a buckle and slide mechanism which is provided for relocating the second location in a direction that is generally parallel to a length dimension of the golf bag body. A second shoulder strap has opposite ends attached to the golf bag body at third and fourth locations that are spaced apart in another direction that is generally transverse to the body length dimension. In an alternative embodiment of the double strap system, the lower end of the first shoulder strap may be connected to either one of a pair of attachment devices mounted on the golf bag body to thereby relocate the second location.

9 Claims, 5 Drawing Sheets

DOUBLE STRAP SYSTEM FOR GOLF BAGS

BACKGROUND OF THE INVENTION

This invention relates generally to golf equipment and, in particular, to a double strap system for golf bags.

Conventional golf bags for carrying golf clubs have a single shoulder strap that may be looped over either shoulder of a person carrying the golf bag. Since conventional golf bags are supported on only one shoulder at a time, there is a tendency for undue shoulder fatigue and soreness. Therefore, golf bag strap systems which minimize or eliminate such undue shoulder fatigue and soreness are desirable.

U.S. Pat. No. 2,853,111 to A. K. Williams discloses a golf bag with a pair of shoulder straps arranged side by side. Each strap has one end permanently fastened to the golf bag and another end detachably connected to the golf bag by a buckle. Although the Williams strap arrangement permits a golf bag to be carried by a person on both shoulders, it is unsuitable when a person desires to carry the golf bag on only one shoulder.

U.S. Pat. No. 5,042,704 to T. J. Izzo discloses a strap carrying system for golf bags including a single shoulder strap that is connected to a golf bag at three spaced locations to provide a pair of loops which may be supported on a person's shoulders. The Izzo system permits a person to carry a golf bag utilizing both shoulders instead of only one shoulder which has been customary. With the Izzo system installed, carrying a golf bag on only one shoulder is inconvenient because the golf bag will be not be properly balanced.

U.S. Pat. No. 5,269,449 to W. A. Sattler discloses a supplemental carry strap for use on golf bags having a handle and a single shoulder strap. The supplemental carry strap of Sattler includes a shoulder element connected to a coupling element which is connected by a hook and loop device to the golf bag handle. U.S. Pat. No. 5,348,205 to S. T. Steurer discloses a strap arrangement for golf bags consisting of two shoulder straps adapted for connection to a handle on a golf bag. Another embodiment of the Steurer strap arrangement includes a secondary shoulder strap which is connected to a golf bag handle. The Sattler and Steurer straps are primarily intended for retrofitting existing golf bags with an auxiliary shoulder strap.

SUMMARY OF THE INVENTION

The present invention provides a double strap system for use in combination with a golf bag for carrying golf clubs. The golf bag includes a generally tubular body with a top end, a bottom end, and a length dimension measured between the top and bottom ends. The double strap system comprises a first shoulder strap having an upper end attached to the body at a first location adjacent the top end thereof and a lower end attached to the body at a second location intermediate the top and bottom ends thereof. Means are provided for relocating the second location in a direction that is generally parallel to the length dimension of the body. The second shoulder strap has opposite ends attached to the body at third and fourth locations disposed intermediate the top and bottom ends. The third and fourth locations are spaced apart in another direction that is generally transverse to the length dimension of the body.

In one embodiment of the double strap system, the relocating means comprises a buckle and slide mechanism for relocating the second location in the first-mentioned direction. In another embodiment of the double strap system, the relocating means comprises a pair of attachment devices for relocating the second location in the first-mentioned direction. The first shoulder strap has an overall length measured between its upper and lower ends, and first adjustment means are provided for adjusting the overall length of the first shoulder strap. The second shoulder strap also has an overall length measured between its opposite ends, and second adjustment means are provided for adjusting the overall length of the second shoulder strap.

DESCRIPTION OF THE PREFERRED EMBODIMENT

Figure 1:
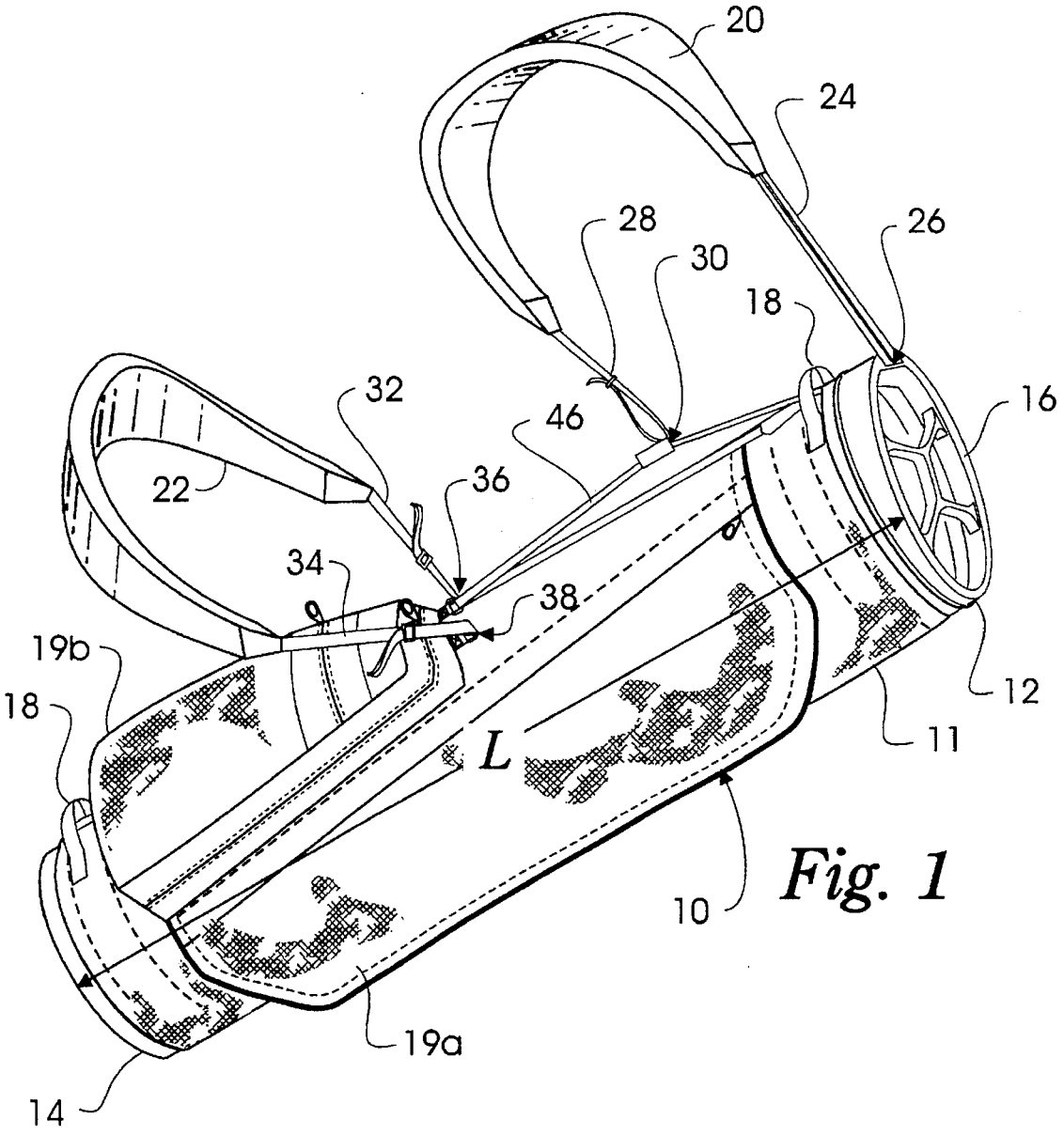
FIG. 1 is a perspective view of a golf bag embodying a double strap system according to one embodiment of the present invention.

Referring to FIG. 1, a golf bag 10 for carrying golf clubs has a generally tubular body 11 with a top end 12, a bottom end 14, and a length dimension L measured between the top and bottom ends 12, 14. The top end 12 of the body 11 is defined by a throat structure 16 such as disclosed in U.S. Pat. No. 4,596,328 to John A. Solheim. Golf clubs may be inserted into and removed from the body 11 through the top end 12 in a conventional manner. A pair of handles 18 are provided on the body 11 near its top and bottom ends 12, 14. The golf bag 10 has accessory pockets 19*a*, 19*b* mounted on the body 11.

The golf bag 10 has a double strap system which includes a first shoulder strap 20 and a second shoulder strap 22. The first shoulder strap 20 has an upper end 24 attached to the body 11 at a first location 26 adjacent its top end 12 and a lower end 28 attached to the body 11 at a second location 30 intermediate its top and bottom ends 12, 14. The second location 30 is relocatable in a direction that is generally parallel to the length dimension L of the body 11. The second shoulder strap 22 has opposite ends 32, 34 attached to the body 11 at third and fourth locations 36, 38, respectively, disposed intermediate the top and bottom ends 12, 14. The third and fourth locations 36, 38 are spaced apart in a direction that is generally transverse to the length dimension L of the body 11.

Figure 2:
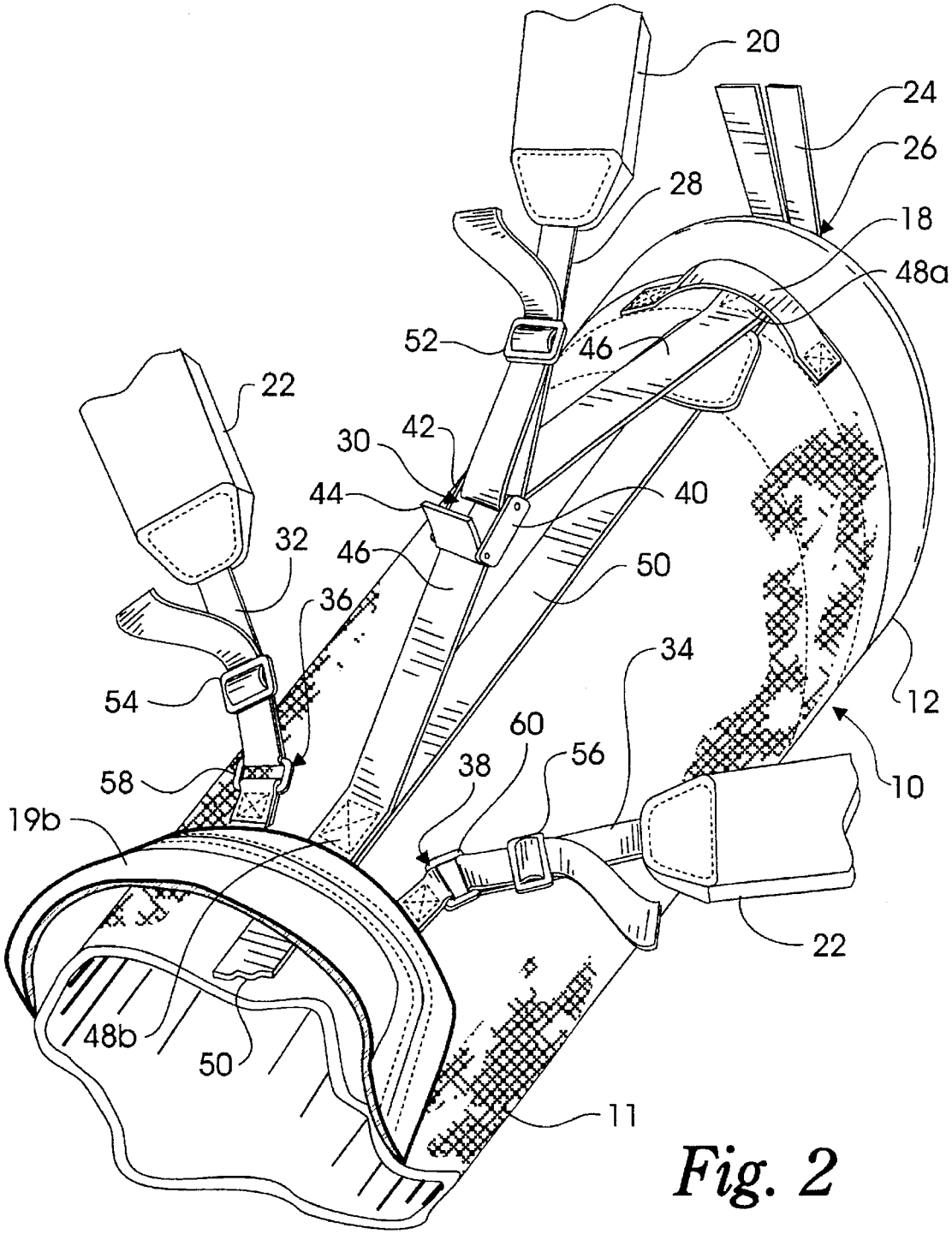
FIG. 2 is an enlarged view of the double strap system shown in FIG. 1.
Figure 2A:
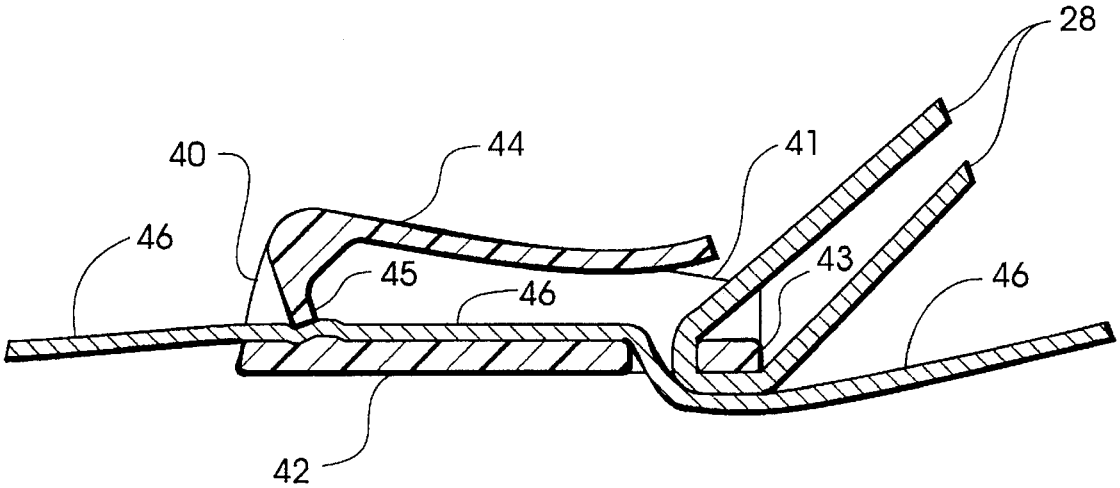
FIGS. 2*a* and 2*b* are enlarged sectional views of part of the double strap system shown in FIG. 1.
Figure 2B:
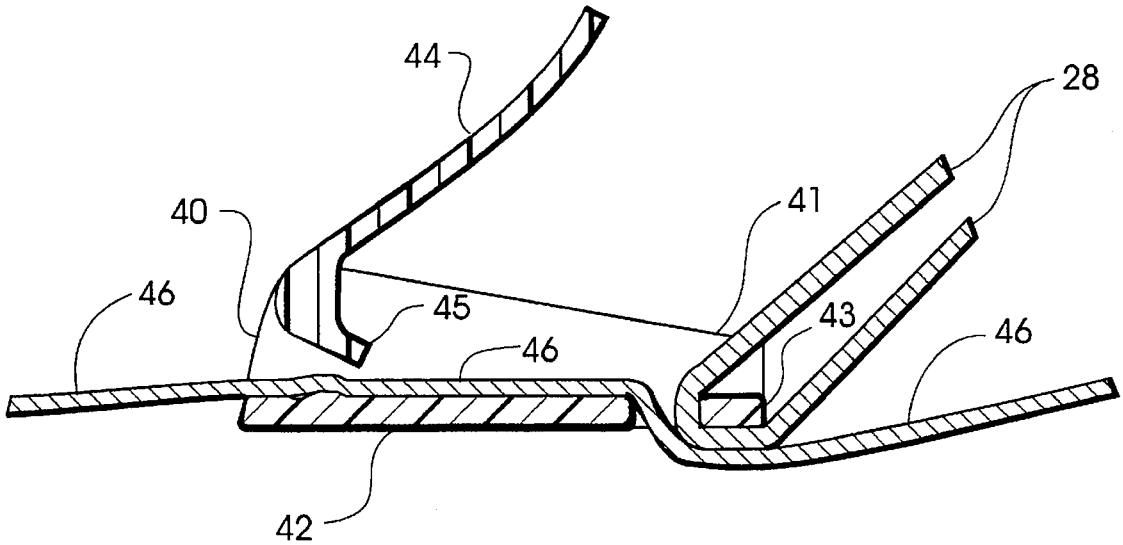

Referring to FIGS. 2, 2*a* and 2*b*, a buckle and slide mechanism 40 is provided at the relocatable second location 30. The mechanism 40 has a pair of side walls 41, a base plate 42 extending between the side walls 41, and a lever 44 pivotally mounted on the side walls 41 for movement between a closed position (FIG. 2*a*) and an opened position (FIG. 2*b*). The lower end 28 of the first shoulder strap 20 is connected to the mechanism 40 since it is looped around a cross bar 43 which extends between the side walls 41 of the mechanism 40. An anchoring strap 46 passes through the mechanism 40 between the base plate 42 and the cross bar 43. The lever 44 has a projection 45 at one end that engages the strap 46 and clamps it against the base plate 42 when the lever 44 is moved into its closed position as shown in FIG.

2*a*. The strap 46 is released when the lever 44 is moved into its opened position as shown in FIG. 2*b*.

The strap 46 has its upper and lower ends 48a, 48b fixed by stitching to a longitudinal strip 50 that is attached to the body 11. It will be understood that the second location 30 may be relocated anywhere along the strap 46 by moving the lever 44 into its opened position (FIG. 2*b*) and then sliding the mechanism 40 along the strap 46 to a new location before moving the lever 44 into its closed position (FIG. 2*a*). When the lever 44 is in its closed position, the strap 46 is securely clamped between the base plate 42 and the lever projection 45 to define the second location 30.

The first shoulder strap 20 has an adjustment device 52 located on its lower end 28 for adjusting the overall length of the strap 20 in a conventional manner. Likewise, the second shoulder strap 22 has adjustment devices 54, 56 located on its opposite ends 32, 34 for adjusting the overall length of the strap 22. By utilizing the adjustment devices 52, 54 and 56, the shoulder straps 20 and 22 may have their overall lengths adjusted as desired.

When both shoulder straps 20 and 22 are used to carry the golf bag 10, the second location 30 is preferably relocated to a position near the upper end 48*a* of the strap 46 by sliding the mechanism 40 along the strap 46. The double strap system may be converted to a single strap system by disconnecting the ends 32, 34 of the second shoulder strap 22 from rings 58 and 60 which are mounted on the body 11 at the third and fourth locations 36 and 38, respectively. Next, the second location 30 is preferably relocated to a position near the lower end 48b of the strap 46 by sliding the mechanism 40 along the strap 46.

Figure 3:
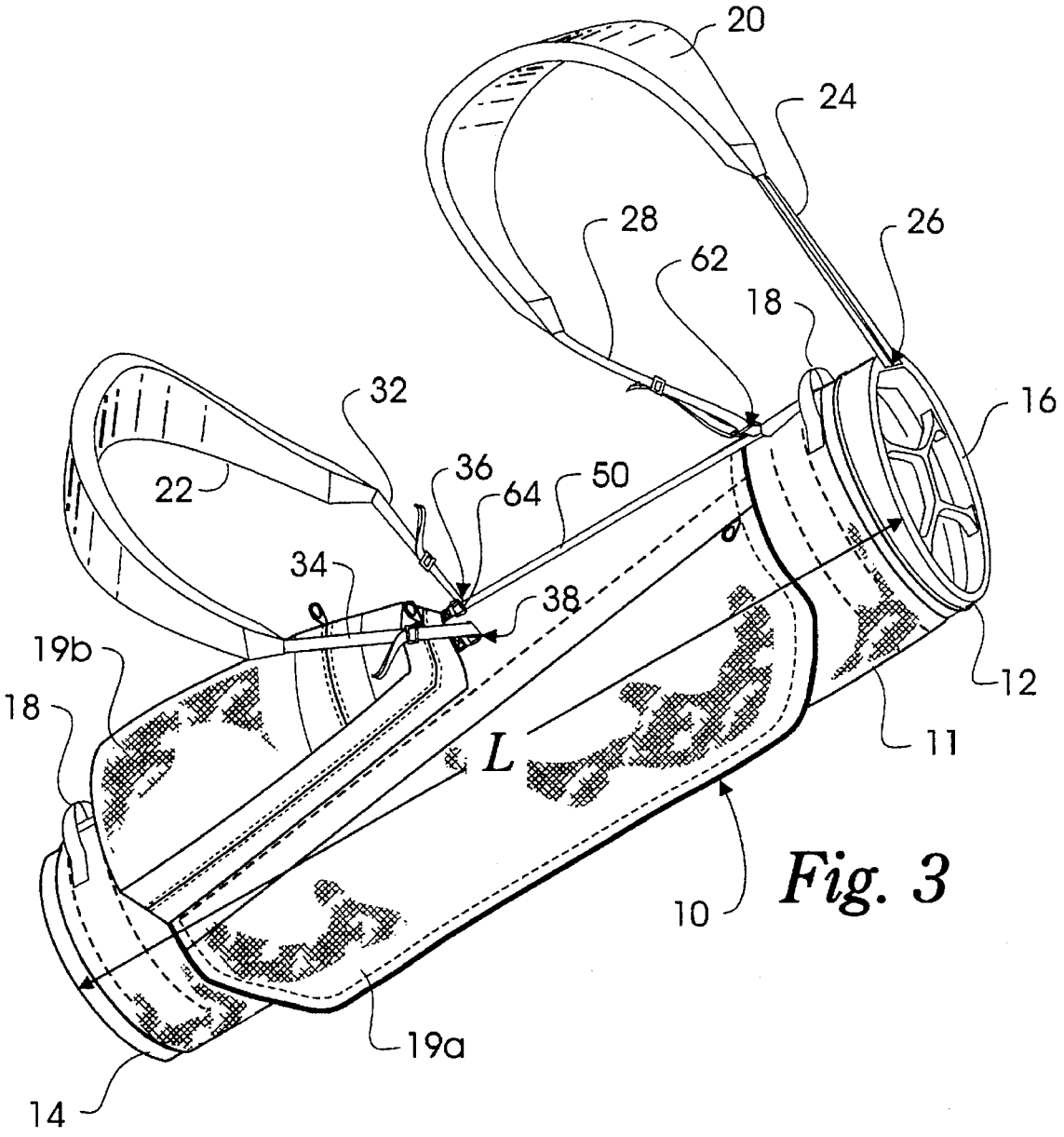
FIG. 3 is a perspective view of a golf bag embodying a double strap system according to another embodiment of the present invention.
Figure 4:
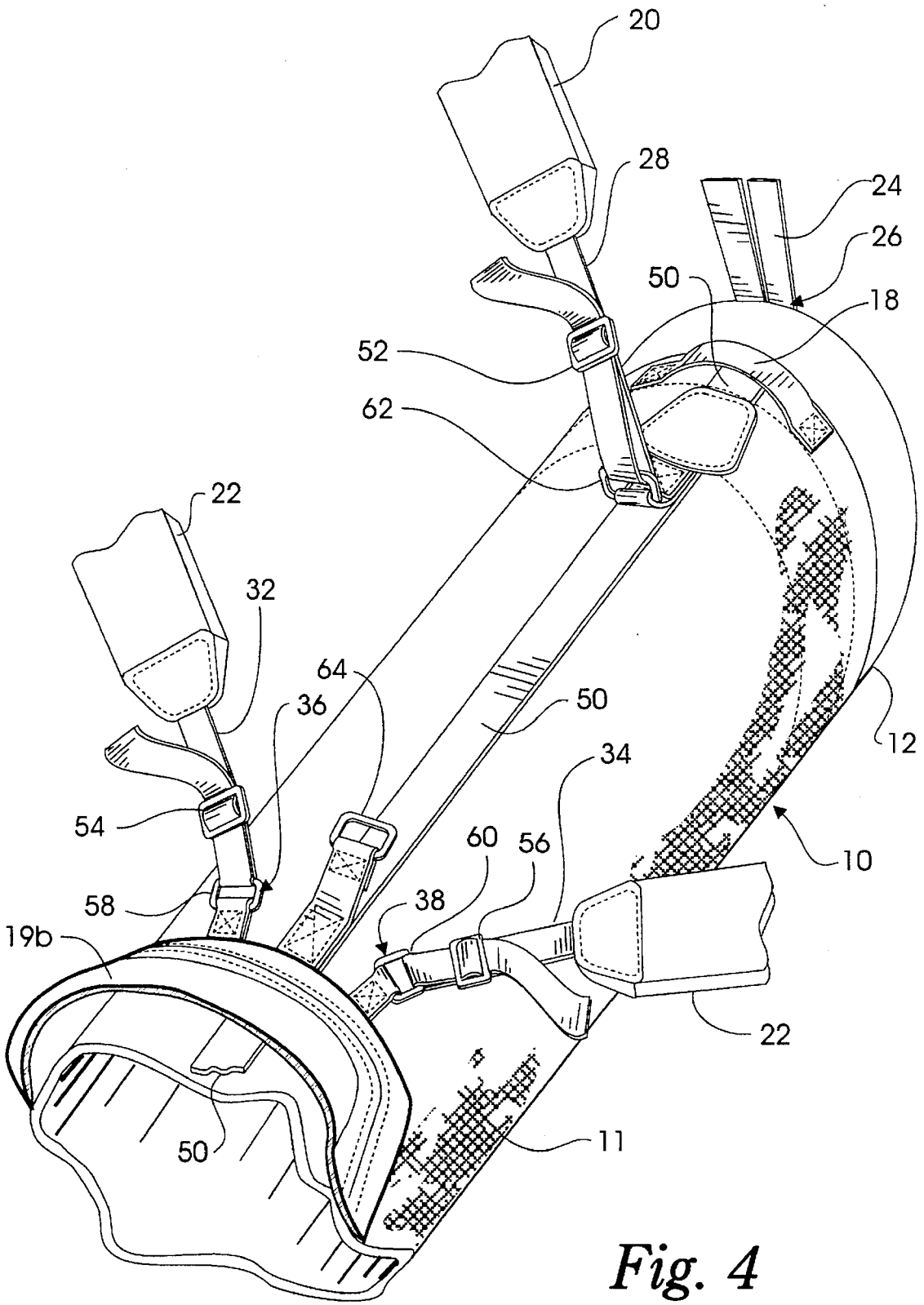
FIG. 4 is an enlarged view of the double strap system shown in FIG. 3.

In FIG. 3, the golf bag 10 has been modified by eliminating the buckle and slide mechanism 40 and replacing it with a pair of attachment rings 62, 64 mounted on the body 11. The strap 46 has also been eliminated in this modification of the golf bag 10. When both shoulder straps 20 and 22 are used to carry the golf bag 10, the lower end 28 of the first shoulder strap 20 is preferably connected to the ring 62. If the shoulder strap 22 is removed, the lower end 28 of the shoulder strap 20 is relocated and connected to the ring 64 in order to convert the double strap system to a single strap system.

What is claimed is:

1. In combination with a golf bag for carrying golf clubs wherein the golf bag has a generally tubular body with a top end, a bottom end, and a length dimension measured between said top and bottom ends, a double strap system comprising:

a first shoulder strap having an upper end attached to said body at a first location adjacent said top end thereof and a lower end attached to said body at a second location intermediate said top and bottom ends thereof, means for relocating said second location in a direction that is generally parallel to the length dimension of said body;

a second shoulder strap having opposite ends attached to said body at third and fourth locations disposed intermediate said top and bottom ends thereof, said third and fourth locations being spaced apart in another direction that is generally transverse to the length dimension of said body;

said relocating means comprising a buckle and slide mechanism on said body for relocating said second location in said first-mentioned direction, said lower end of said first shoulder strap being connected to said buckle and slide mechanism; and an anchoring strap affixed to said body, said buckle and slide mechanism being slidable along said anchoring strap in order to relocate said second location.

2. The double strap system of claim 1, wherein said first shoulder strap has an overall length measured between its upper and lower ends, and further comprising first adjustment means for adjusting the overall length of said first shoulder strap.

3. The double strap system of claim 2, wherein said first adjustment means is located on said lower end of said first shoulder strap.

4. The double strap system of claim 2, wherein said second shoulder strap has an overall length measured between its opposite ends, and further comprising second adjustment means for adjusting the overall length of said second shoulder strap.

5. The double strap system of claim 4, wherein said second adjustment means is located on at least one of said opposite ends of said second shoulder strap.

6. The double strap system of claim 5, further comprising third adjustment means for adjusting the overall length of said second shoulder strap, and wherein said third adjustment means is located on the other one of said opposite ends of said second shoulder strap.

7. The double strap system of claim 1, wherein said buckle and slide mechanism comprises a lever movable between a closed position and an opened position, and wherein said lever has a projection which is engageable with said anchoring strap when said lever is in said closed position.

8. The double strap system of claim 7, wherein said buckle and slide mechanism further comprises a base plate, and wherein said anchoring strap is clamped between said lever projection and said base plate when said lever is moved into said closed position to thereby define said second location.

9. The double strap system of claim 8, wherein said anchoring strap is released when said lever is moved into said opened position so that said buckle and slide mechanism is slidable along said anchoring strap to thereby relocate said second location.

* * * * *